US007222568B1

(12) United States Patent
Shemesh et al.

(10) Patent No.: US 7,222,568 B1
(45) Date of Patent: May 29, 2007

(54) METHOD FOR FLEXOGRAPHIC MULTI-COLOR PRINTING USING ANILOX ROLLERS HAVING DIFFERENT DIAMETERS

(75) Inventors: Ron Shemesh, Greenwich, CT (US); Bodo Steinmeier, Bielefeld (DE); Wolfgang Brusdeilins, Bielefeld (DE); Gordon Whitelaw, Bielefeld (DE); Andreas Kückelmann, Ibbenbüren (DE)

(73) Assignee: Fischer & Krecke GmbH & Co., Bielefeld (DE)

( * ) Notice: Subject to any disclaimer, the term of this patent is extended or adjusted under 35 U.S.C. 154(b) by 0 days.

(21) Appl. No.: 11/318,253

(22) Filed: Dec. 23, 2005

(51) Int. Cl.
*B41M 1/14* (2006.01)
*B41F 5/18* (2006.01)

(52) U.S. Cl. ..... 101/211; 101/183; 101/171

(58) Field of Classification Search ..... 101/181, 101/183, 151, 152, 170, 178, 202, 205, 211, 101/348, 349.1, 350.1, 363, 171; *B41F 5/18*
See application file for complete search history.

(56) References Cited

U.S. PATENT DOCUMENTS

| | | | | |
|---|---|---|---|---|
| 5,513,566 | A * | 5/1996 | Lehmann et al. | 101/156 |
| 6,647,880 | B2 * | 11/2003 | Kolbe et al. | 101/424 |
| 6,796,226 | B2 * | 9/2004 | Kolbe et al. | 100/171 |
| 2003/0134732 | A1 * | 7/2003 | Kolbe et al. | 492/59 |

* cited by examiner

*Primary Examiner*—Leslie J. Evanisko
(74) *Attorney, Agent, or Firm*—Richard M. Goldberg

(57) ABSTRACT

A method for flexographic multi-color printing, wherein a print medium web is passed continuously through a flexographic printing press having at least two ink units, each ink unit including a printing cylinder, an anilox roller and an ink sup-ply system adapted to supply liquid ink of a specific color to the anilox roller, wherein the inks supplied in the different ink units differ in both, color and mass density, the method including the steps of mounting, in at least one of the ink units, an anilox roller having a larger diameter than the anilox roller of another one of the at least two ink units, and during printing, supplying the ink with the largest mass density to the anilox roller having the larger diameter.

6 Claims, 1 Drawing Sheet

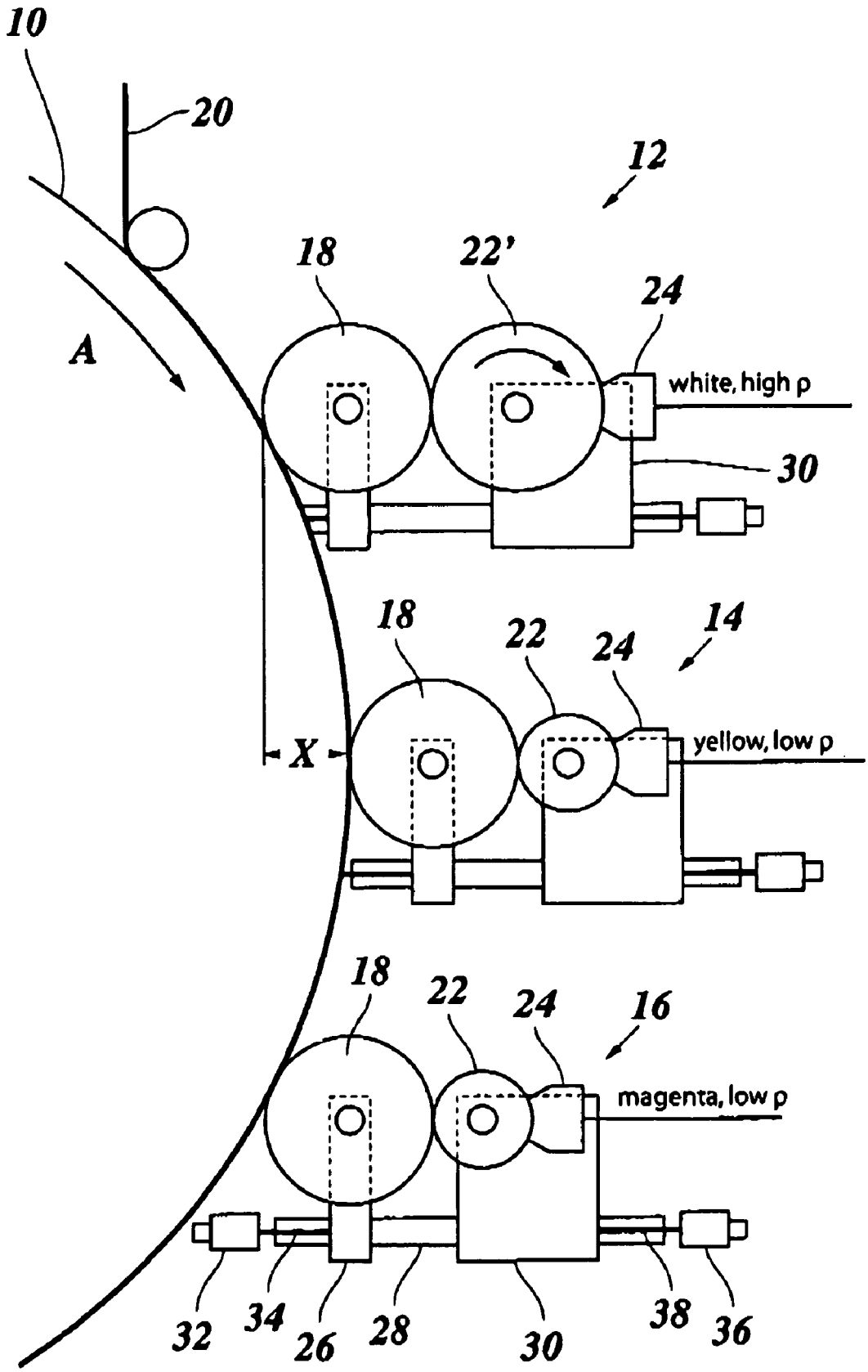
10
20
12
18
22'
24
A
white, high ρ
30
18
22
24
14
X
yellow, low ρ
18
22
24
16
magenta, low ρ
32
34
26
28
30
38
36

METHOD FOR FLEXOGRAPHIC MULTI-COLOR PRINTING USING ANILOX ROLLERS HAVING DIFFERENT DIAMETERS

BACKGROUND OF THE INVENTION

The invention relates to a method for flexographic multi-color printing.

In a typical flexographic multi-color print process, an endless web of a print medium, e.g. paper, is passed around a major portion of the periphery of a central impression cylinder, and, while the central impression cylinder is rotating, inks of different colors are successively printed onto the web by means of ink units that are distributed along the periphery of the central impression cylinder. Each ink unit comprises a print cylinder, which is adjusted against the web on the periphery of the central impression cylinder and carries a printing plate which defines a print pattern that corresponds to a color component of the image to be printed. The ink is applied to the printing cylinder by means of an anilox roller the peripheral surface of which has a regular pattern of finely distributed pits. The periphery of the anilox roller passes through an ink fountain, e.g. a chambered doctor blade, where the pits are filled with ink. When the anilox roller rotates, the ink to the pits is transferred to a nip formed between the anilox roller and the printing cylinder, and, in this nip, the ink is transferred onto elevated, printing parts of the print pattern that is formed on the printing plate.

The color image that is to be printed on the endless web has a certain repeat length which defines the required peripheral length of the printing cylinders. Since the color component images that are printed with the printing cylinders of all the ink units contribute to the same image, they all have the same repeat length, and, accordingly, the printing cylinders of all ink units have the same diameter. Likewise, in a conventional flexographic printing press, the anilox rollers of all ink units have the same diameter.

The peripheral speed of the anilox roller is equal to the peripheral speed of the printing cylinder which itself is essentially equal to the speed with which the web is advanced on the peripheral surface of the central impression cylinder, i.e. the printing speed. Due to the rotation of the anilox roller, the ink in the pits at the peripheral surface of the anilox roller are subject to centrifugal forces which have to be overcome by adhesive forces between the liquid ink and the surface of the anilox roller. Since the centrifugal forces increase with increasing speed of rotation of the anilox roller, the printing speed can only be increased up to a limit, where the centrifugal forces would overcome the adhesive forces between the ink and the anilox roller. Since, for a given printing speed and hence a given peripheral speed of the anilox roller, the centrifugal forces are inversely proportional to the diameter of the anilox roller, this diameter should be increased in order to permit a higher printing speed. However, an increased diameter of the anilox rollers leads not only to increased manufacturing costs for the printing press, increased power consumption due to increased weight and moment of inertia of the anilox rollers, and to increased overall dimensions of the printing machine, but also implies longer transfer times for the ink on its way from the ink fountain to the nip between the anilox roller and the printing cylinder. When rapidly drying inks are employed, in order to permit high printing speeds, the increased transfer time may give rise to problems in an initial set-up phase of a print run, in which the machine is operated with a reduced speed. Then, the transfer time may become so long that, undesirably, a portion of the ink dries-out already on the surface of the anilox roller. Thus, a suitable compromise has to be made for the diameter of the anilox rollers.

SUMMARY OF THE INVENTION

It is an object of the invention to propose a method for flexographic multi-color printing, which permits a high printing speed for a wide variety of different inks.

In order to achieve this object, according to the invention, anilox rollers with different diameters are mounted in the various ink units of the machine, and the diameter of the anilox roller of a specific ink unit is determined in accordance with the mass density of the ink that is used in that ink unit.

The invention is based on the observation that the inks that are employed in the various ink units differ not only in their color but also in their mass density. Specifically, the mass density of white ink is significantly larger than the mass density of other color inks, because the white ink has a high content of $TiO_2$ white pigment. Since the centrifugal forces to which the ink is exposed at the periphery of the rotating anilox roller are proportional to the mass density of the ink, it is particularly the white ink, i.e. the ink with the highest mass density, which imposes a limit to the printing speed. Thus, by using an anilox roller with a larger diameter for the white ink and anilox rollers with smaller diameters for the other inks, it is possible to increase the printing speed while keeping the diameters of the anilox rollers for the other inks relatively small, so as to prevent a premature drying of the ink in the set-up phase.

More generally, the ink with the highest mass density is attributed to the ink unit which has the anilox roller with the largest diameter.

The ratios between the diameters of the anilox rollers in the various ink units may be roughly proportional to the ratios between the mass densities of the inks employed therein. The drying properties of the different inks may be another criterion for individually adapting the diameter of each anilox roller to the specific properties of the ink.

The white ink, which has the largest mass density, is typically used for the first and/or the last color component that is printed onto the web. Thus, in the direction of movement of the web along with the periphery of the central impression cylinder, it should be the first ink unit and/or the last ink unit that it equipped with a larger diameter anilox roller. In a conventional design of a flexographic printing press, these first and last ink units are arranged in positions vertically offset from the axis of rotation of the central impression cylinder, whereas two other ink units are arranged approximately in the height of the axis of rotation. Since, consequently, the anilox rollers of the first and last ink units are disposed closer to a vertical line passing through the axis of rotation of the central impression cylinder, there is enough space for accommodating a larger anilox roller, without increasing the overall dimension of the machine.

The past years, drive systems for printing presses have been developed which provide a specific drive motor for each of the anilox rollers and printing cylinders of each ink unit, and the peripheral speeds of the anilox rollers and the printing cylinders are synchronized electronically, so that mechanical gear couplings between the anilox rollers and the printing cylinders can be dispensed with. This facilitates to practice the present invention because, when an anilox roller is to be replaced by one with a larger diameter, it is relatively easy to electronically adjust the rotary speed of the anilox roller in order to provide the correct peripheral speed.

BRIEF DESCRIPTION OF THE DRAWING

An embodiment example of the invention will now be described in conjunction with the single drawing FIGURE, which shows a schematic partial view of a flexographic printing press.

DESCRIPTION OF THE PREFERRED EMBODIMENT

The flexographic printing press shown in the drawing comprises a large-diameter central impression cylinder 10 and a plurality of ink units arranged at the periphery thereof. Only three ink units 12, 14 and 16 are visible in the drawing, but another three ink units will be arranged symmetrically on the opposite side of the central impression cylinder. In practice, the number of ink units may be even larger than six, depending on the number of colors or inks to be employed. For example, the printing press may have a total of ten ink units, five on each side.

Each ink unit comprises a printing cylinder 18 adapted to be adjusted against a web 20 of a print medium which passes over the central impression cylinder 10, an anilox roller 22, 22' for inking the printing cylinder, and an ink supply system comprising, for example, a chamber-type doctor blade 24 for inking the anilox roller 22. The printing cylinders 18 are rotatably supported on brackets 26, and the brackets are slidable on guides 28. The ends of the anilox roller 22 and the doctor blade 24 on either side of the machine are supported on a common bracket 30 which is slidable on the same guide 28 or on a separate guide. A shift mechanism which, in the example shown, is formed by a servo motor 32 and a spindle drive 34, is associated with each of the brackets 26 for the printing cylinders. A separate shift mechanism which is also formed by a servo motor 36 and a spindle drive 38 is associated with each of the brackets 30. Thus, the printing cylinders 18 may be adjusted precisely into a printing position in which they are engaged against the central impression cylinder 10 and hence in contact with a web to be printed. Likewise, the anilox rollers 22 may be adjusted against the printing cylinders 20 and may be lifted off therefrom.

The printing cylinders 18 and also the anilox rollers 22, 22' are exchangeably mounted in their respective brackets. Moreover, the brackets 30 of at least the ink unit 12 are adapted to accommodate anilox rollers 22' of different diameters, which implies that the doctor blade 24 of this ink unit is adjustably mounted on the brackets. The doctor blade 24 of the ink unit 12 is also arranged to be easily exchangeable, in order to adapt to the different curvatures of the peripheries of the anilox rollers 22'.

In the example shown, the machine has been prepared for a print operation in which white ink having a relatively high mass density ρ is employed in the ink unit 12, and inks of other colors, e.g. yellow, magenta, etc., which all have a relatively low mass density, are employed for the other ink units 14, 16. The anilox rollers 22 of the ink units 14 and 16 (and of the other ink units which have not been shown) have an identical, relatively small diameter. However, in view of the higher mass density of the white ink, an anilox roller 22' with a larger diameter has been mounted in the ink unit 12.

During the print operation, the central impression cylinder 10 is continuously rotated with a given speed in a direction indicated by an arrow A, so that the web 20 is successively advanced past the ink units 12, 14, 16, . . . . Thus, the white ink color component will be the first to be printed onto the web 20, as is frequently required in practice. The white ink supplied by the doctor blade 24 is applied onto the peripheral surface of the anilox roller 22 and is then transferred onto the printing cylinder 18 and further onto the web 20. The inks of other color are transferred in the ink units 14, 16 in a similar way.

The peripheral speed of the anilox rollers 22, 22' is essentially equal to the speed of advance of the web 20, i.e. the printing speed. Due to the rotation of the anilox rollers, the ink on the surface thereof is subject to centrifugal forces. As a consequence, the printing speed cannot be increased beyond a limit at which the centrifugal forces would overcome the adhesive forces between the ink and the anilox roller, so that the ink would be flung away. The centrifugal force to which the ink is exposed is proportional to the mass density ρ of the ink and thus tends to be particularly high for the white ink that is printed in the ink unit 12. However, since the anilox roller 22' of this ink unit has a larger diameter than the anilox rollers 22 of the other ink units, and the peripheral speed is fixed, the angular velocity of the anilox roller 22' is smaller than those of the anilox rollers 22. As a result, the centripetal acceleration of the ink at the periphery of the anilox roller 22' is also smaller, and this compensates for the increased mass density of the ink, so that the printing speed can be as high as in a case where ink with low mass density would be employed in all ink units.

In the example shown, the ink unit 14 is disposed in a height which corresponds essentially the height of the axis of rotation (not shown) of the central impression cylinder 10, whereas the ink unit 12 which has the large diameter anilox roller 22' is vertically offset therefrom. As a result, since the printing cylinder 18 of the ink unit 12 engages the peripheral surface of the central impression cylinder 10, the horizontal position of the ink unit 12 is shifted inwardly of the printing machine relative to the ink unit 14 by an amount X. This provides sufficient space for accommodating the larger diameter anilox roller 22' in the ink unit 12 without increasing the overall dimensions of the machine.

Although, in the example shown, an anilox roller 22' with larger diameter is employed only in one ink unit 12, it is possible to mount larger diameter anilox rollers also in other ink units of the machine, depending on the ink that is printed therewith. Frequently, for example, white ink with high mass density is also used for the last color component to be printed. Then, an ink unit which would be the mirror image of the ink unit 12 on the other side of the central impression cylinder 10 would also be equipped with a large diameter anilox roller.

In another embodiment, the diameters of the anilox rollers 22 in the ink units 14, 16, . . . may be individually adapted to the properties of the specific inks, so that the annex rollers of all the ink units may have three or more different diameters.

When an anilox roller is to be lifted off from its printing cylinder, by shifting the anilox roller along the guide 28, a suitable control program assures that the amount by which the brackets 30 are shifted will always be adapted to the specific diameter of the anilox roller. When an anilox roller is to be exchanged, it is automatically shifted into a predefined change-over position which is independent of the diameter of the specific roller and is compatible with a given, conventional roller exchange system.

What is claimed is:

1. A method for flexographic multi-color printing, wherein a print medium web is passed continuously through a flexographic printing press having at least two ink units, each ink unit comprising a printing cylinder, an anilox roller and an ink supply system adapted to supply ink of a specific color to the anilox roller, wherein the inks supplied in the different ink units differ in both color and mass density, the method comprising the steps of:

mounting, in a same printing press at the same time, in at least one of the ink units, an anilox roller having a larger diameter than the anilox roller of another one of said at least two ink units, and during printing in a same printing operation in the same printing press, supplying the ink with the largest mass density to the anilox roller having the larger diameter.

2. The method of claim 1, wherein white ink is supplied to the anilox roller having the larger diameter.

3. The method of claim 1, wherein the web is moved successively past said at least two inking units, and the anilox roller having the larger diameter is mounted in the ink unit which comes first in the direction of movement of the web.

4. The method of claim 1, wherein the web is moved successively past said at least two inking units, and the anilox roller having the larger diameter is mounted in the ink unit which comes last in the direction of movement of the web.

5. The method of claim 1, wherein said ink units are arranged around a periphery of a central impression cylinder having a central axis disposed in a certain height, and the anilox roller having the larger diameter is mounted in one of the ink units which is vertically offset from the height of the central axis of the central impression cylinder.

6. The method of claim 1, wherein the diameters of the anilox rollers that are mounted in the different ink units are selected in accordance with the mass densities of the inks supplied thereto, so that ink on the peripheral surface of the anilox rollers will be subject to an essentially identical centrifugal force in all ink units, the method comprising a step of controlling a peripheral speed of the anilox rollers, which speed corresponds to the speed with which the web is moved past the ink units, to a value at which the centrifugal force experienced by the ink is slightly smaller than an adhesive force holding the ink on the peripheral surface of the anilox rollers.

* * * * *